US008830159B2

(12) United States Patent
Liu et al.

(10) Patent No.: US 8,830,159 B2
(45) Date of Patent: Sep. 9, 2014

(54) CONTROLLER CIRCUITRY FOR LIGHT EMITTING DIODES

(75) Inventors: Da Liu, Milpitas, CA (US); Yung-Lin Lin, Palo Alto, CA (US)

(73) Assignee: O2Micro International Limited, Grand Cayman (KY)

( * ) Notice: Subject to any disclaimer, the term of this patent is extended or adjusted under 35 U.S.C. 154(b) by 0 days.

(21) Appl. No.: 12/962,030

(22) Filed: Dec. 7, 2010

(65) Prior Publication Data

US 2011/0074839 A1 Mar. 31, 2011

Related U.S. Application Data

(63) Continuation of application No. 11/247,831, filed on Oct. 11, 2005, now Pat. No. 7,847,783.

(51) Int. Cl.

| | |
|---|---|
| ***G09G 3/36*** | (2006.01) |
| ***G09G 3/32*** | (2006.01) |
| ***G09G 3/10*** | (2006.01) |
| ***H05B 37/00*** | (2006.01) |
| ***H05B 33/08*** | (2006.01) |
| ***G09G 3/34*** | (2006.01) |

(52) U.S. Cl.

CPC .... *H05B 33/0827* (2013.01); *G09G 2320/0233* (2013.01); *H05B 33/0815* (2013.01); *G09G 3/342* (2013.01); *G09G 2320/0633* (2013.01); *G09G 2330/021* (2013.01); *G09G 2320/0666* (2013.01); *G09G 3/3413* (2013.01)

USPC ..... 345/102; 345/82; 315/169.3

(58) Field of Classification Search

USPC ..... 345/82, 102; 315/216, 163, 169.3

See application file for complete search history.

(56) References Cited

U.S. PATENT DOCUMENTS

| | | | | |
|---|---|---|---|---|
| 6,028,468 | A | 2/2000 | Menniti et al. | |
| 6,949,892 | B2 | 9/2005 | Horiuchi et al. | |
| 7,265,681 | B2 * | 9/2007 | Chen | 340/815.45 |
| 7,307,614 | B2 * | 12/2007 | Vinn | 345/102 |
| 7,365,718 | B2 | 4/2008 | Tsuchida et al. | |
| 2004/0257003 | A1 * | 12/2004 | Hsieh et al. | 315/246 |
| 2005/0127883 | A1 * | 6/2005 | Hoshino et al. | 323/274 |

FOREIGN PATENT DOCUMENTS

| | | | |
|---|---|---|---|
| CN | 1515037 | A | 7/2004 |
| JP | H08-056148 | A | 2/1996 |
| JP | 2004-039684 | A | 2/2004 |

* cited by examiner

*Primary Examiner* — Amr Awad
*Assistant Examiner* — Andre Matthews
(74) *Attorney, Agent, or Firm* — Pillsbury Winthrop Shaw Pittman LLP

(57) ABSTRACT

A method according to one embodiment may include supplying power to an LED array having at least a first string of LEDs and a second string of LEDs coupled in parallel, each of the strings includes at least two LEDs. The method of this embodiment may also include comparing a first feedback signal from the first string of LEDs and a second feedback signal from the second string of LEDs. The first feedback signal is proportional to current in said first string of LEDs and said second feedback signal is proportional to current in said second string of LEDs. The method of this embodiment may also include controlling a voltage drop of at least the first string of LEDs to adjust the current of the first string of LEDs relative to the second string of LEDs, based on, at least in part, the comparing of the first and second feedback signals. Of course, many alternatives, variations, and modifications are possible without departing from this embodiment.

6 Claims, 8 Drawing Sheets

CONTROLLER CIRCUITRY FOR LIGHT EMITTING DIODES

CROSS REFERENCE TO RELATED APPLICATIONS

This application is a continuation application of U.S. Non-provisional application Ser. No. 11/247,831 filed Oct. 11, 2005, now U.S. Pat. No. 7,847,783, the teachings all of which are incorporated herein by reference.

FIELD

The present disclosure relates to controller circuitry for light-emitting-diodes (LEDs).

BACKGROUND

LEDs are becoming popular for the lighting industry, particularly for backlighting the liquid crystal displays (LCDs.). The advantages of using LEDs for lighting equipment includes power saving, smaller size and no use of hazardous materials compared to fluorescent lighting devices. In addition, the power supply for LEDs usually operates with relatively low voltage which avoids any high-voltage potential issues associated with power supply for fluorescent lamps. For example, a cold cathode fluorescent lamp may require more than a thousand Volts AC to start and operate, whereas a single LED only requires about 1 to 4 Volts DC to operate.

To provide sufficient brightness, a display system requires many LEDs to produce comparable brightness as generated by a single fluorescent lamp. The challenge of using LEDs for lighting system is to optimize the brightness perception of human being eyes, in addition to balancing current in the LEDs. Brightness of color and color perception to human eyes vary significantly. For example, human eyes strongly perceive yellow color as comparing to green color. Therefore, in applications such as a traffic light, the amount of power delivered for the yellow light is lower than the power delivered for the green light to reach approximately equal eye perception.

There are different configurations for the multiple LEDs used in the lighting system. LEDs can be connected in series, in parallel or in serial-parallel combinations.

FIGS. 1A and 1B depict power supply circuits, 10 and 20, respectively, for parallel LEDs. Parallel LEDs receive a common supply voltage line from a power supply circuit. Usually, current is regulated by either monitoring the total amount of current in all the LEDs or the current in a single LED. Due to variation in the voltage drop of an LED, each LED may not carry the same current and therefore, produces different amount of brightness. Uneven brightness affects the lifetime of the LEDs. FIG. 1C shows a modified power supply circuit 30 so that each output provides power for one LED. In this case the power supply is complex and expensive. Such configuration is limited to low power LED system that contains few LEDs.

FIG. 2A depicts a power supply circuit 40 for serial LEDs. Each LED may have 1.0 Volt to 4.0 Volts voltage drop when an adequate amount of current is flowing through. It is the current flow in LED determines the brightness of the LED. The voltage drop correspondingly, depends on the manufacture of the LED, and the voltage drop can vary significantly. Therefore, the serial configuration has the advantage of regulating the string LED current so that each LED emits approximately same amount of brightness. For single-string LEDs, regulating the current of LED string for the power supply circuit is more suitable than regulating the voltage across the LED string. Power supply for such applications involves converting power source to a regulated output by current-mode control. Such application is bounded for number of LEDs in series which constitutes the voltage across the entire LED string. Too high a voltage limits the benefit of low-cost semiconductor device in the power supply circuit. For example, for a 12.1" LCD display uses 40 LEDs for illumination. The voltage at the output of the converter may reach 150 Volts. The cost of the semiconductor switches to produce this voltage is prohibitive for such applications.

FIG. 2B depicts a power supply 50 for serial-parallel connected LEDs. Many LEDs are divided into multiple strings to reduce the cost of the converter circuit so that inexpensive semiconductor switches can be used. This configuration has the advantage of serial connection to provide the same amount of current flowing through the LEDs in the same string. The challenge, however, is in balancing the current among the strings as discussed in parallel LED configuration. The problem can be solved by using multiple power supplies with each power supply providing power to one string of LEDs. For example, each string of LEDs is operated by a separate DC/DC converter. However, multiple power stages for providing power to LED strings is bulky, not cost effective and is complicated. Often, this configuration may require synchronization of all power supplies to avoid any beat-frequency noise in the system.

SUMMARY

One embodiment described herein may provide a controller for a light-emitting diode (LED) array. The controller may include DC/DC converter circuitry capable of supplying power to an LED array. The LED array may include at least a first string of LEDs and a second string of LEDs coupled in parallel together, each string comprising at least two LEDs. The controller may also include feedback circuitry capable of receiving a first feedback signal from the first string of LEDs and a second feedback signal from the second string of LEDs. The first feedback signal is proportional to current in the first string of LEDs and the second feedback signal is proportional to current in the second string of LEDs. The feedback circuitry is further capable of comparing first and second feedback signals and, based on, at least in part, the comparing, controlling a voltage drop to adjust the current of the first string of LEDs relative to the second string of LEDs.

A method according to one embodiment may include supplying power to an LED array having at least a first string of LEDs and a second string of LEDs coupled in parallel, each of the strings includes at least two LEDs. The method of this embodiment may also include comparing a first feedback signal from the first string of LEDs and a second feedback signal from the second string of LEDs. The first feedback signal is proportional to current in said first string of LEDs and said second feedback signal is proportional to current in said second string of LEDs. The method of this embodiment may also include controlling, based on, at least in part, the comparing, controlling a voltage drop of the first string of LEDs to adjust the current of the first string of LEDs relative to the second string of LEDs.

At least one system embodiment described herein may provide an LED array comprising at least a first string of LEDs and a second string of LEDs coupled in parallel, each string comprising at least two LEDs. The system may also provide a controller capable of supplying power to the LED array, the controller is further capable of receiving a first feedback signal from the first string of LEDs and a second feedback signal from the second string of LEDs, the first feedback signal is proportional to current in the first string of LEDs and the second feedback signal is proportional to current in the second string of LEDs. The controller is further capable of comparing first and second feedback signals and, based on, at least in part, the comparing, controlling a voltage drop of the first string of LEDs to adjust the current of the first string of LEDs relative to the second string of LEDs.

BRIEF DESCRIPTION OF THE DRAWINGS

Features and advantages of embodiments of the claimed subject matter will become apparent as the following Detailed Description proceeds, and upon reference to the Drawings, wherein like numerals depict like parts, and in which:

Although the following Detailed Description will proceed with reference being made to illustrative embodiments, many alternatives, modifications, and variations thereof will be apparent to those skilled in the art. Accordingly, it is intended that the claimed subject matter be viewed broadly, and be defined only as set forth in the accompanying claims.

DETAILED DESCRIPTION

Figure 1A:
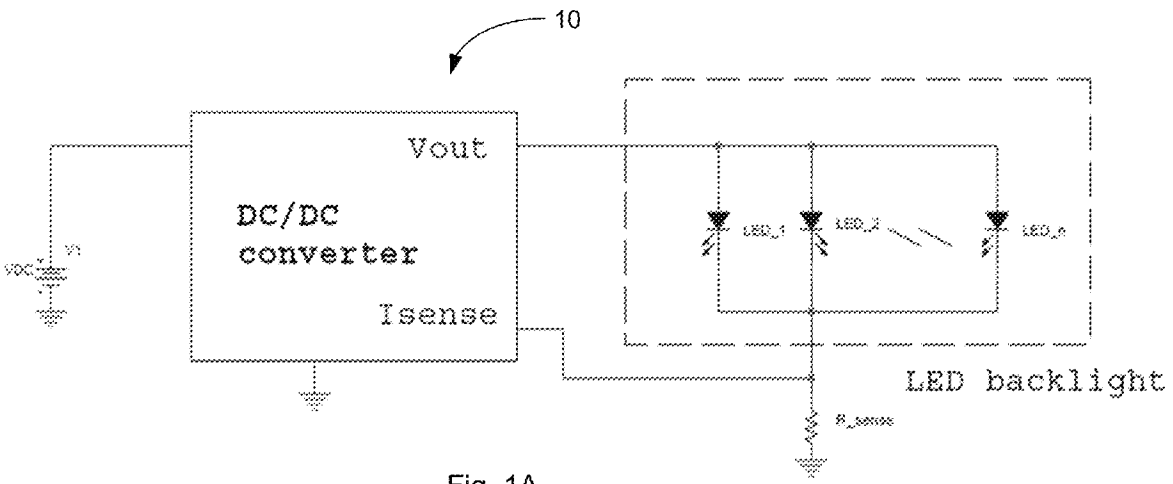
Fig. 1A PRIOR ART
FIG. 1A-C are diagrams illustrating conventional LED system arrangements.
Figure 1B:
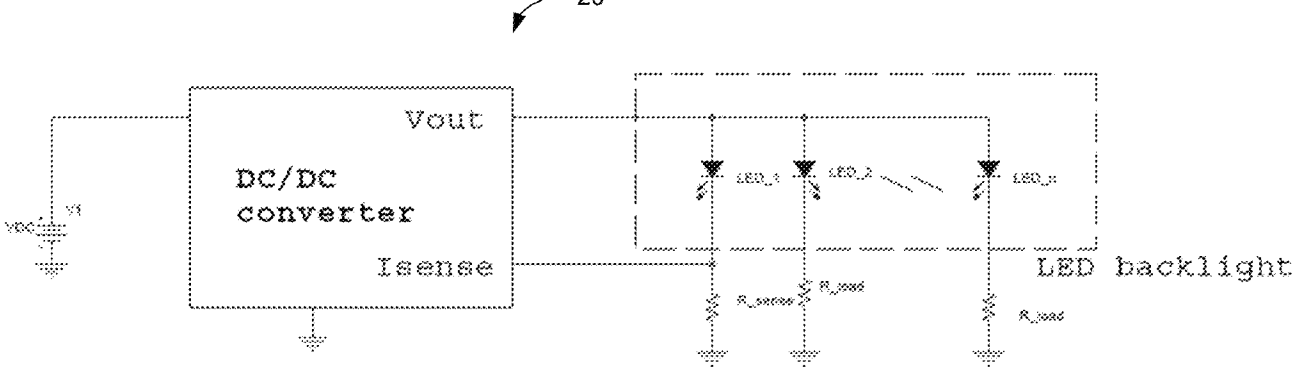
Fig. 1B PRIOR ART
Figure 1C:
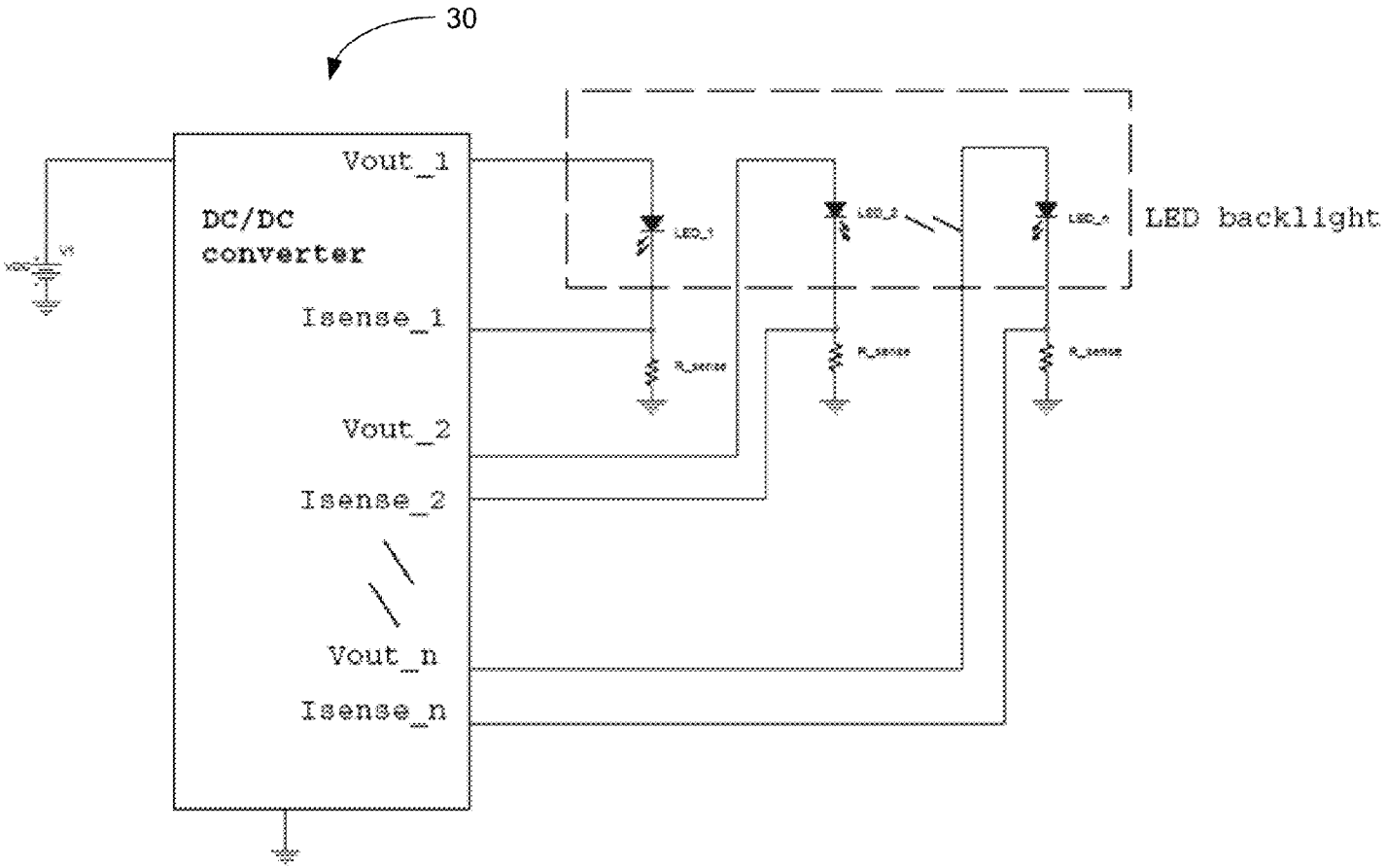
Fig. 1C PRIOR ART
Figure 2A:
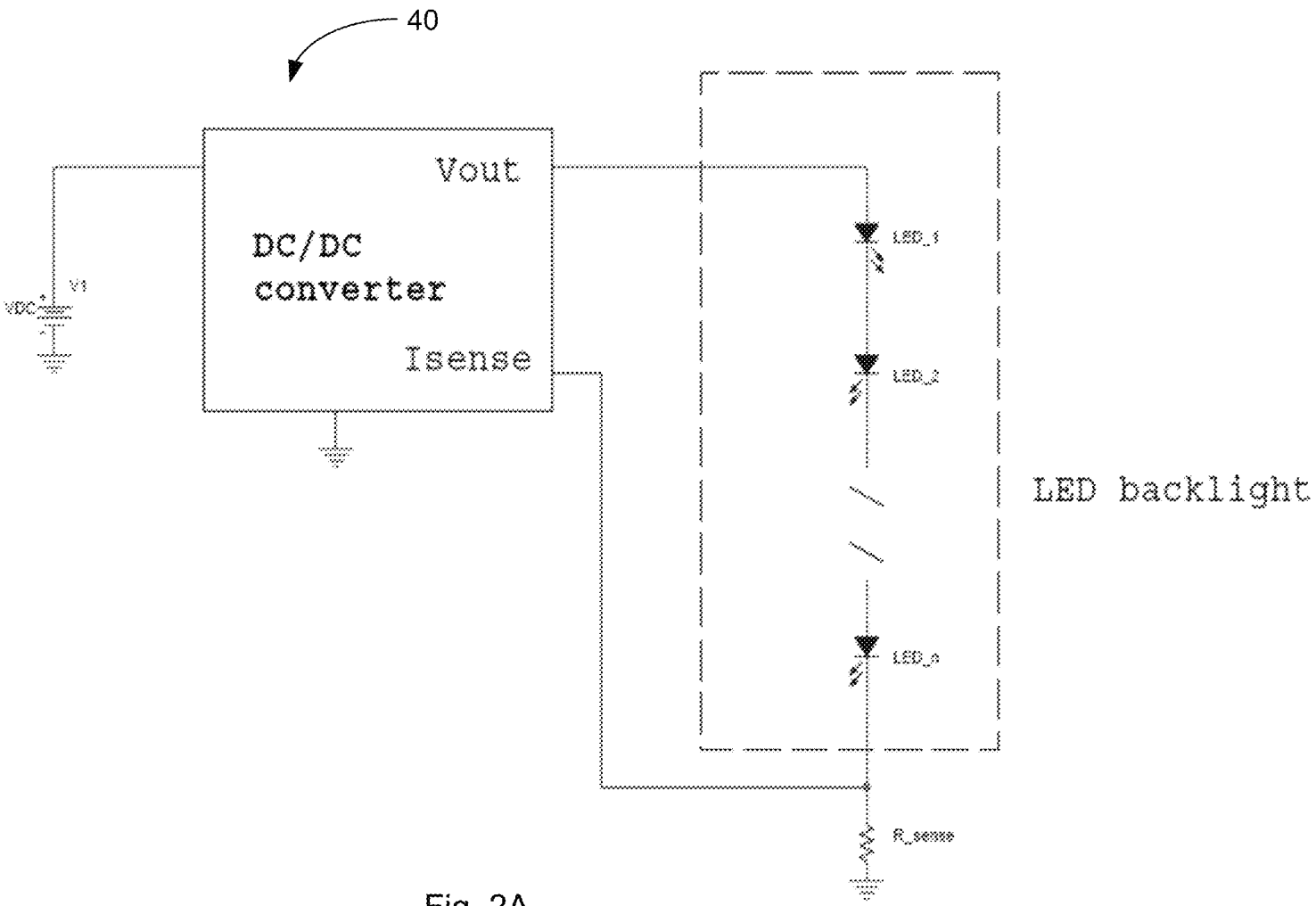
Fig. 2A PRIOR ART
FIGS. 2A-B are diagrams illustrating other conventional LED system arrangements.
Figure 2B:
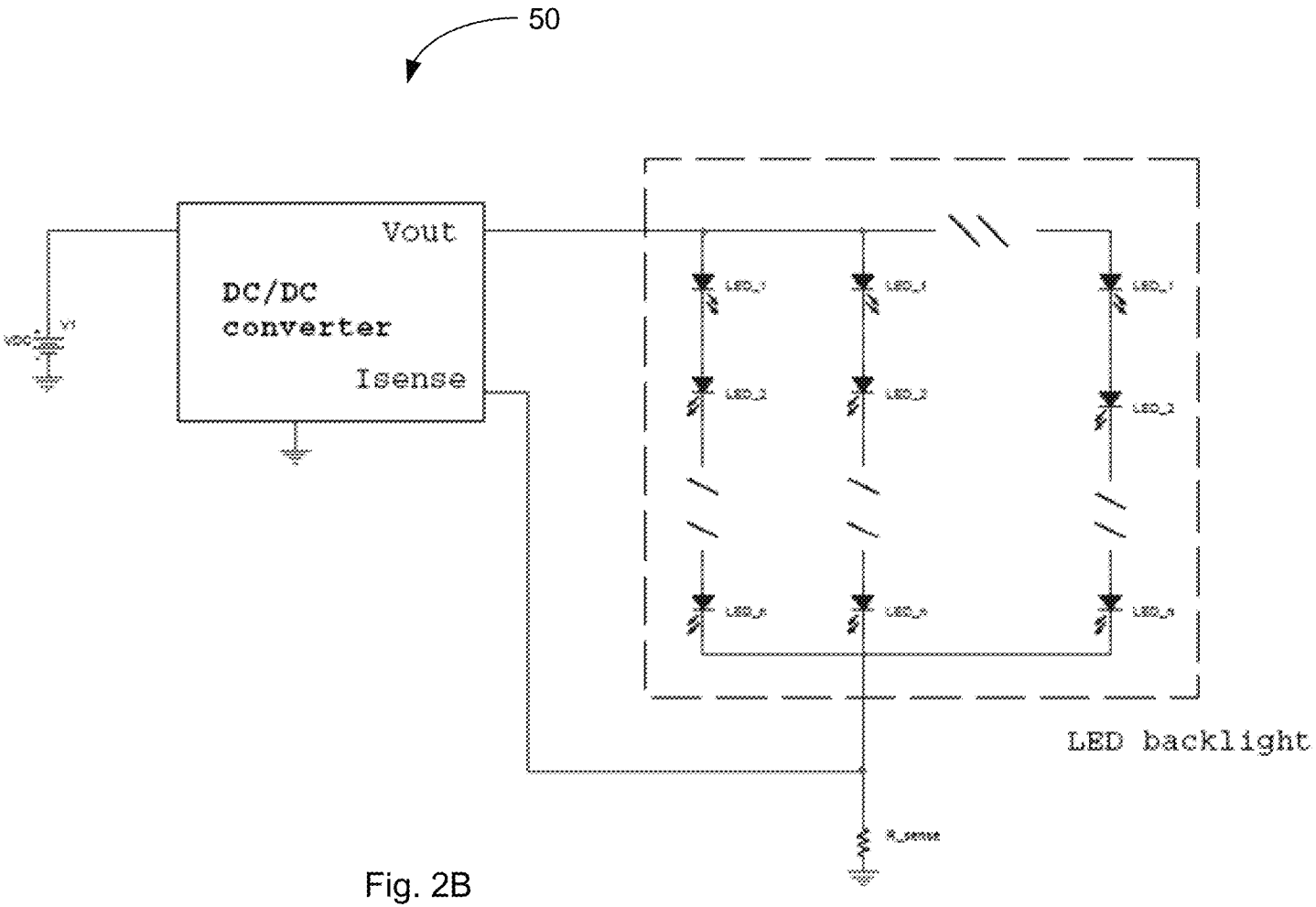
Fig. 2B PRIOR ART
Figure 3:
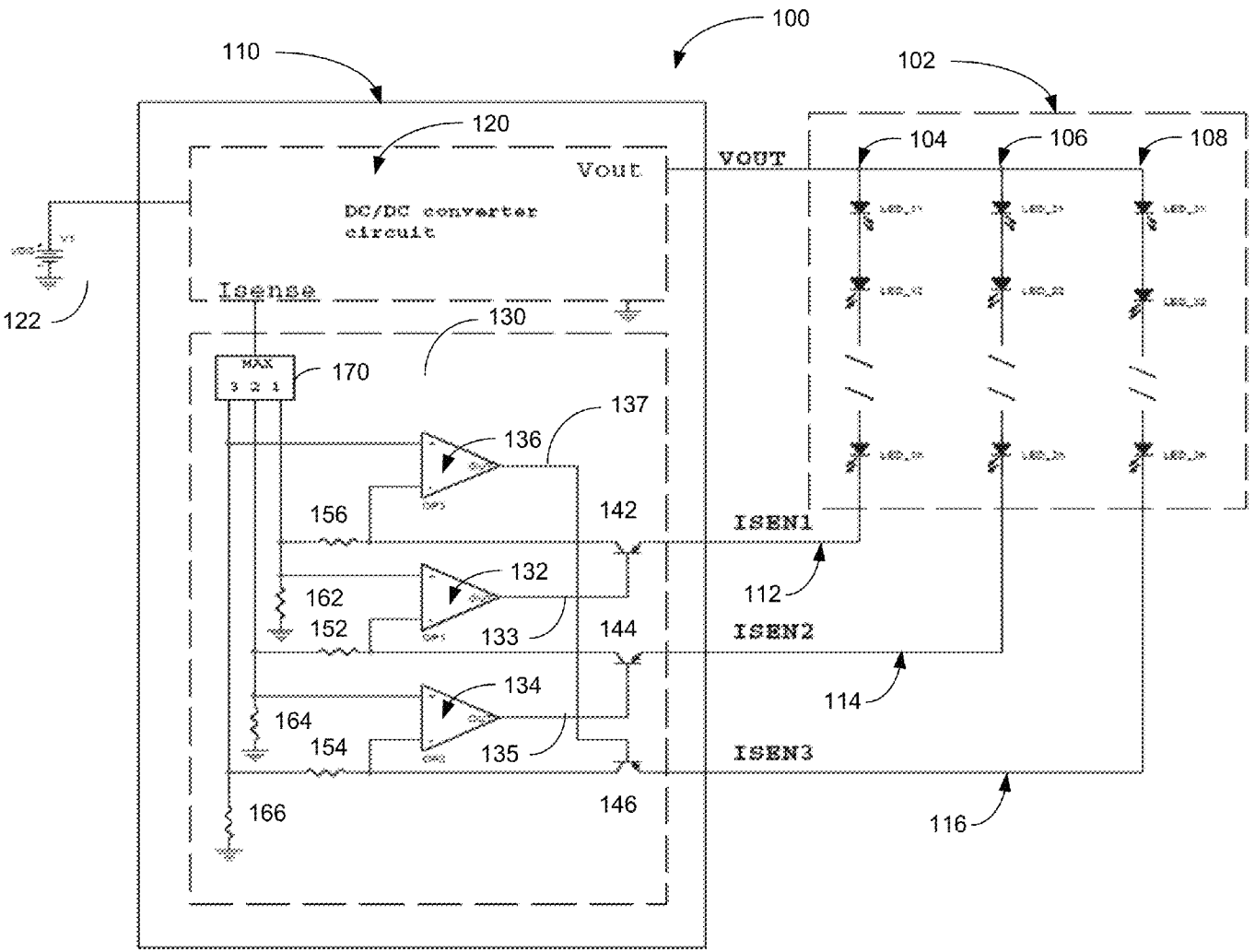
FIG. 3 illustrates one exemplary system embodiment of the claimed subject matter.

FIG. 3 illustrates one exemplary system embodiment 100 of the claimed subject matter. The system 100 may generally include an LED array 102 and LED backlight controller circuitry 110. The LED array may form part of, for example, an LED backlight for a Liquid Crystal Display (LCD) panel. The LED array 102 may include a plurality of LED strings 104, 106 and 108. Each string 104, 106, and 108 may include a plurality of serially connected LEDs, for example, a first string 104 may include a plurality of LEDs connected in series, e.g., LED_11, LED_12, . . . , LED_1*n*. Similarly, a second string 106 may include a plurality of LEDs connected in series, e.g., LED_21, LED_22, . . . , LED_2*n*, and a third string 108 may include a plurality of LEDs connected in series, e.g., LED_31, LED_32, . . . , LED_3*n*. Strings 104, 106 and 108 may be coupled together in parallel and to power supply, designated as Vout in the Figure. Thus, the voltage across each string may be represented by Vout. Each string may generate respective feedback signals 112, 114 and 116 (labeled Isen1, Isen2 and Isen3, respectively). Feedback signals 112, 114 and 116 may be proportional to the current in each respective string.

LED backlight controller circuitry 110 may include DC/DC converter circuitry 120 capable of generating a DC power Vout from a DC input 122. Controller circuitry 110 may individually or collectively comprise one or more integrated circuits. As used in any embodiment herein, an "integrated circuit" means a semiconductor device and/or microelectronic device, such as, for example, a semiconductor integrated circuit chip. Exemplary DC/DC converter circuitry 110 may include Buck, Boost, Buck-Boost, Sepic, Zeta, Cuk and/or other known or after-developed circuit topologies. Controller circuitry 110 may also include feedback circuitry 130 capable of balancing the current in each string of LEDs. In one embodiment, feedback circuitry 130 may be capable of comparing the current in one string to the current in at least one other string. The voltage drop of one or the other strings may be adjusted to adjust the current in one of the strings, based upon, at least in part, a difference between the relative current in the two LED strings. Exemplary operations of feedback circuitry 130 are discussed in greater detail below.

Feedback circuitry 130 may include amplifier circuitry 132, 134 and 136, one for each string 104, 106 and 108. Feedback circuitry may also include switches 142, 144 and 146, which may be configured to conduct respective feedback signals 112, 114 and 116. To that end, switches 142, 144 and 146 may be controlled such that the voltage drop across each switch may generate a desired current condition in each string of LEDs, as will be described herein. In this embodiment, switches 142, 144 and 146 may each comprise bipolar junction transistors (BJTs), where each respective current feedback signal 112, 114 and 116 is conducted from the emitter through the collector, and the base is controlled to control the value of the signal transmitted through the switch. Offset resistors 152, 154 and 156 may be coupled to each input of the amplifiers to reduce or eliminate offset errors which may be associated with the amplifiers. Sense resistors 162, 164 and 166 may be coupled to each respective current feedback signal 112, 114 and 116, and the input of each amplifier may be a voltage signal taken across respective sense resistors 162, 164 and 166. Sense resistors may be used to generate a proportional value of the feedback signals 112, 114 and 116. To achieve substantially equal current in each string of LEDs, the sense resistors may be substantially identical. However, and as will be described in embodiments below, the sense resistors may be selected to achieve different current values for each string of LEDs, relative to one another.

The current in any string may be proportional to Vout minus the voltage drop across an associated switch. Thus, for example, the current in string 104 may be proportional to Vout minus V (switch 142). Thus, by controlling the voltage drop across switch 142, the current in string 104 may be controlled. In this embodiment, the current in string 104 may be controlled relative to the current in string 106 by controlling the voltage drop across switch 142.

For example, in this embodiment, amplifier 132 may be configured to receive current feedback signal 112 (from the first string 104) via switch 142 and current feedback signal 114 (from the second string 106) via switch 144. More particularly, amplifier 132 may be configured to receive, at a non-inverting input, a voltage signal proportional to the current feedback signal 112 (taken across sense resistor 162) and, at an inverting input, a voltage signal proportional to the current feedback signal 114 (taken across sense resistor 164). Amplifier 132 may compare the relative values of signals 112 and 114 and generate a control signal 133. Control signal 133 may have a value that is based on, at least in part, the difference between signal 112 and 114. In this example, feedback current signal 112 may be applied to a non-inverting input of amplifier 132, and signal 114 may be applied to an inverting input of amplifier 132. Control signal 133 may control the conduction state of switch 142, for example, by controlling the base voltage of the switch 142. Each switch may be configured so that when balanced current flows through each string of LEDs, the output of the amplifier is at low state so that the switches are fully saturated. This may operate to reduce power losses associated with the transistors under such condition.

Controlling the conduction of switch 142 may operate to control the voltage drop across switch 142. As an example, if signal 112 is greater than signal 114, amplifier 132 may generate a higher control signal 133 (as compared to a state when signal 112 is equal to or less than signal 114). A higher control signal 133, applied to switch 142, may cause the base current to decrease and thus, the voltage drop across switch 142 to increase. Increasing the voltage drop across switch 142 may decrease the current 112 through LED string 104. This process may continue until the current values 112 and 114 are substantially identical. These operations illustrate the voltage drop across LEDs in string 104 has lower voltage drop than that of the voltage drop across LEDs in string 106.

Similarly, if signal 112 is less than signal 114, amplifier 132 may generate a lower control signal 133 (as compared to a state when signal 112 is equal to or greater than signal 114). A lower control signal 133, applied to switch 142, may cause the base current to increase and thus, the voltage drop across switch 142 to decrease. Decreasing the voltage drop across switch 142 may increase the current 112 through LED string 104. This process may continue until the current values 112 and 114 are substantially identical.

Amplifier 136 may be configured to receive current feedback signal 116 (from the third string 108) via switch 146 and current feedback signal 112 (from the first string 104) via switch 142. Amplifier 136 may compare the relative values of signals 116 and 112 and generate a control signal 137. Control signal 137 may have a value that is based on, at least in part, the difference between signal 116 and 112. In this example, feedback current signal 116 via sense resistor 166 may be applied to a non-inverting input of amplifier 136, and signal 112 via sense resistors 156, 162 may be applied to an inverting input of amplifier 136. Control signal 137 may control the conduction state of switch 146, for example, by controlling the base voltage of the switch 146. Controlling the conduction of switch 146 may operate to control the voltage drop across switch 146. As an example, if signal 116 is greater than signal 112, amplifier 136 may generate a higher control signal 137 (as compared to a state when signal 116 is equal to or less than signal 112). A higher control signal 137, applied to switch 146, may cause the base current to decrease and thus, voltage drop across switch 146 to increase. Increasing the voltage drop across switch 146 may decrease the current 116 through LED string 108. This process may continue until the current values 116 and 112 are substantially identical.

Similarly, if signal 116 is less than signal 112, amplifier 136 may generate a lower control signal 137 (as compared to a state when signal 116 is equal to or greater than signal 112). A lower control signal 137, applied to switch 146, may cause the voltage drop across switch 146 to decrease. Decreasing the voltage drop across switch 146 may increase the current 116 through LED string 108. This process may continue until the current values 116 and 112 are substantially identical.

In this embodiment, feedback signal 112, 114 and/or 116 may be supplied to DC/DC converter circuitry 120. Based upon, at least in part, the value of feedback signal 112, 114 and/or 116, DC/DC converter circuitry 120 may be capable of adjusting Vout to achieve preset and/or desired current conditions in at least one LED string 104, 106 and/or 108. Although not shown in this Figure, it is equally contemplated under this embodiment that controller circuitry 110 includes user-controllable circuitry (which may comprise, for example, software and/or hardware) to preset a desired brightness of the LCD panel. In that instance, DC/DC converter circuitry may adjust power to the LED array based on the preset value as set by the user and the value of feedback signal 116.

Feedback circuitry 130 may also include pass-through circuitry 170 capable of providing at least one feedback signal 112, 114 and/or 116 to the DC/DC converter circuitry 120. In this embodiment, pass-through circuitry may operate as an OR gate, allowing at least one of the feedback signals across sense resistor 162, 164 and/or 166 to flow through to converter circuitry 120. This may enable, for example, circuitry 120 to continue to receive feedback information in the event that one or more strings 104, 106 and/or 108 becomes an open circuit.

Figure 4:
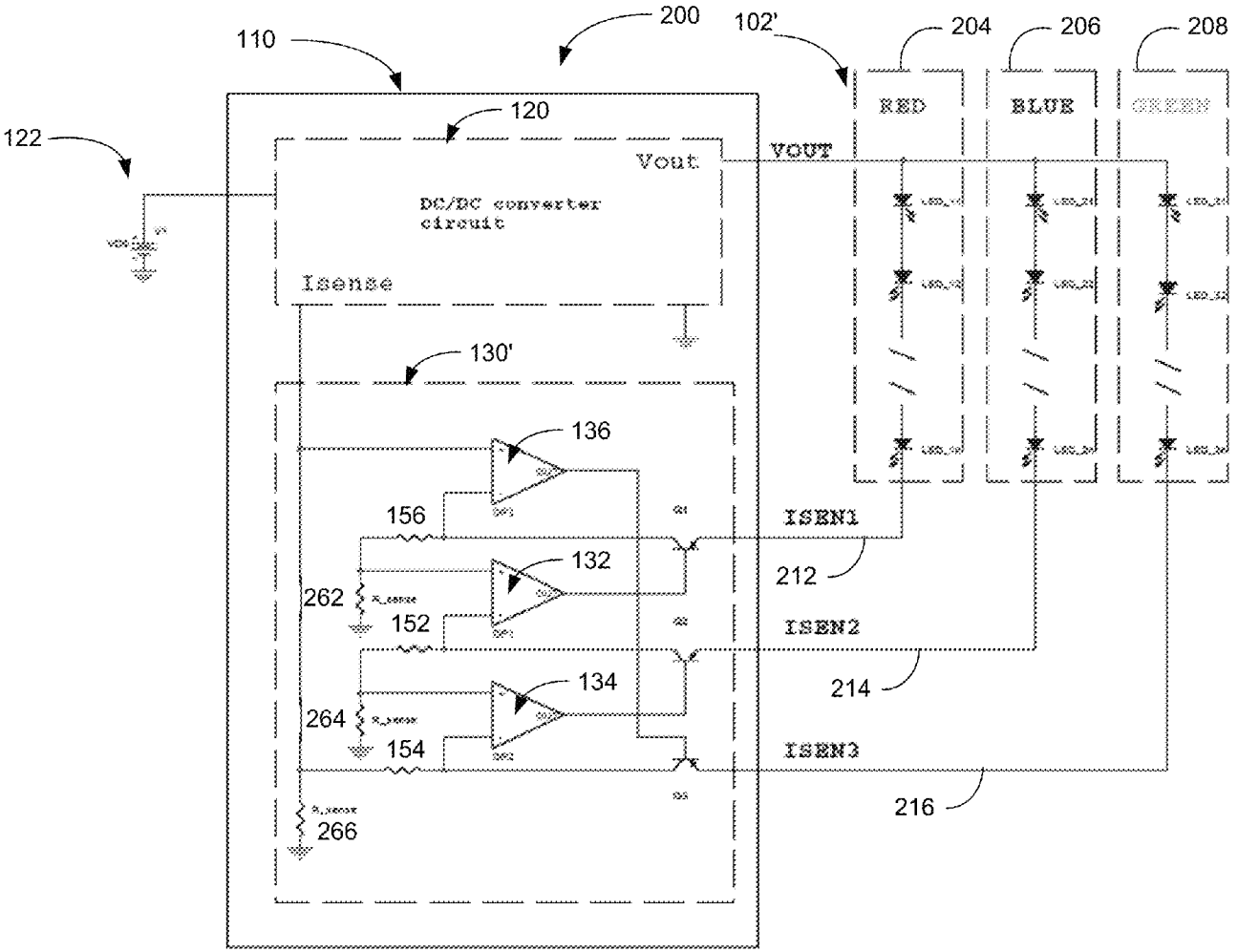
FIG. 4 illustrates another exemplary system embodiment of the claimed subject matter.

FIG. 4 illustrates another exemplary system embodiment 200 of the claimed subject matter. In this embodiment, LED array 102' may include a red LED string 204 having at least one LED capable of emitting red light, a blue LED string 206 having at least one LED capable of emitting blue light, and a green LED string 208 having at least one LED capable of emitting green light. Strings 204, 206 and 208 may be coupled together in parallel and to power supply, designated as Vout in the Figure. Thus, the voltage across each string may be represented by Vout. Each string may generate respective signals 212, 214 and 216 (labeled Isen1, Isen2 and Isen3, respectively). Signals 212, 214 and 216 may be proportional to the current in each respective string.

In this embodiment, it may be desirable to adjust the ratio between red light emitted by string 204, blue light emitted by string 206 and green light emitted by string 208. Accordingly, the feedback circuitry 130' of this embodiment may include sense resistors 262, 264 and 266. Sense resistors 262, 264 and/or 266 may have different values, for example, depending on a particular application. Current signals 212, 214 and 216 may be adjusted by adjusting the values of the sense resistors 262, 264 and 266, respectively. As described above in detail, the signal at the sense resistor 262 may be an input to amplifier 132 proportional to signal 212. Thus, the control signal generated by amplifier 132 may be based on, at least in part, the ratio between sense resistors 262 and 264 so that the current in the red string 204 may be a predetermined multiple/factor of the current in the blue string. Similarly, the control signal generated by amplifier 134 may be based on, at least in part, the ratio between sense resistors 264 and 266 so that the current in the blue string 206 may be a predetermined multiple/factor of the current in the green string 208. Also, the control signal generated by amplifier 136 may be based on, at least in part, the ratio between sense resistors 266 and 262 so that the current in the green string 204 is some multiple/factor of the current in the red string. In addition to the operations described above, feedback circuitry 130' in this embodiment may operate in manner similar to feedback circuit 130 described above with reference to FIG. 3.

Figure 5:
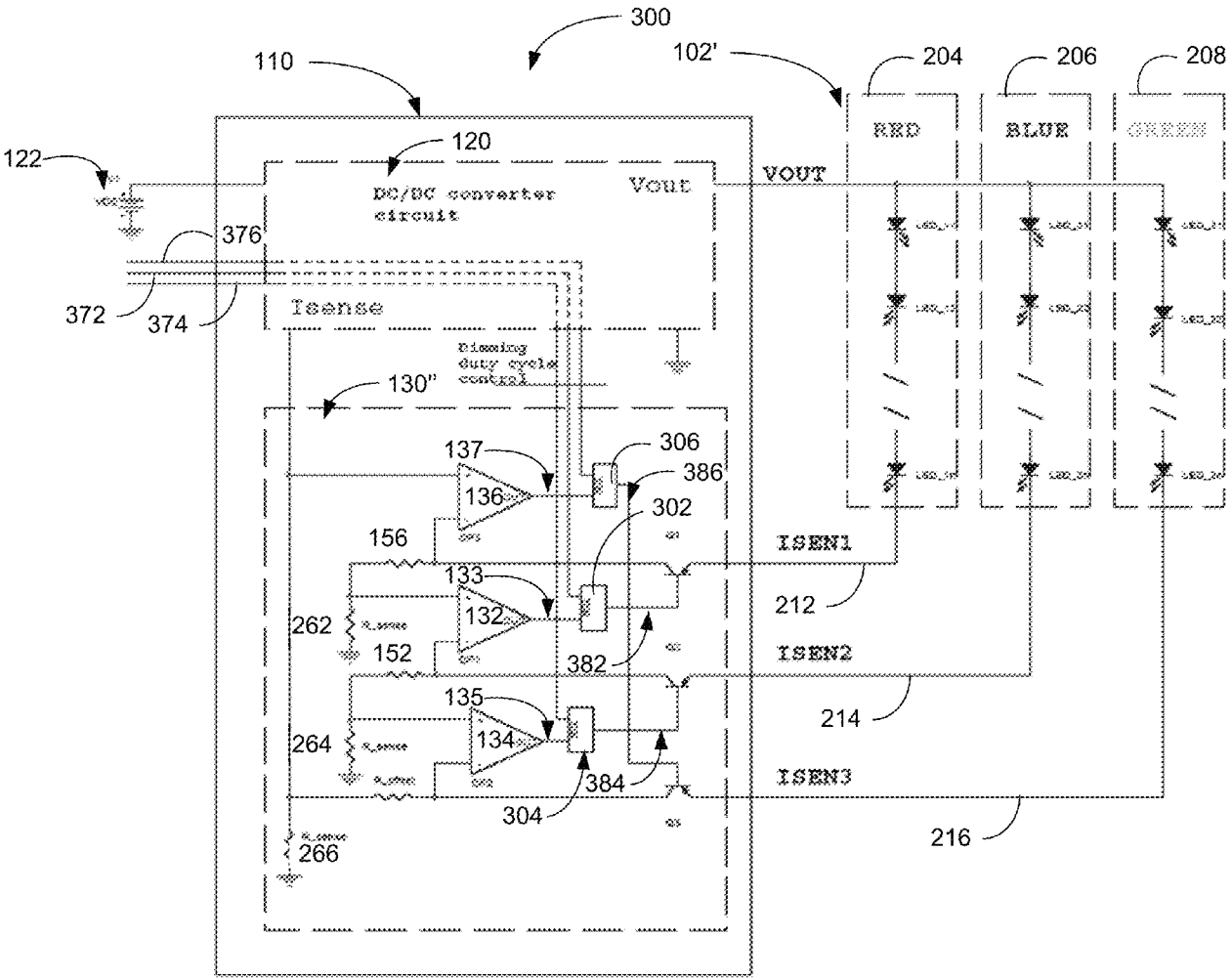
FIG. 5 illustrates another exemplary system embodiment of the claimed subject matter.

FIG. 5 illustrates another exemplary system embodiment 300 of the claimed subject matter. In this embodiment, feedback circuitry 130" may include burst mode dimming circuitry which may control the brightness of at least one LED string 204, 206 and/or 208. Burst mode dimming circuitry may capable of adjusting the brightness of string 204, 206 and/or 208 by regulating the flow of the feedback signal 212, 214 and/or 216, as will be described below.

Feedback circuitry 130" may include multiplexer circuitry 302, 304 and 306. Multiplexer 302 may have a first input configured to receive a pulse width modulated (PWM) signal 372 and a second input configured to receive control signal 133. The multiplexer circuitry 302 may generate an output signal 382 based on the PWM signal 372 and control signal 133. The PWM signal 372 may comprise a low frequency burst mode signal, and may be designated for specific brightness control of the red LED string 204. For example, the PWM signal 372 may comprise a rectangular waveform having a selected ON-OFF duty cycle, i.e., the waveform swings from HIGH to LOW based on a selected duty cycle. The frequency of the PWM signal 372 may be selected to avoid flickering of the LEDs, for example, several hundred Hertz.

In operation, if the PWM signal 372 is HIGH, the output signal 382 of the multiplexer may be the control signal 133. Thus, when the PWM signal 372 is HIGH, switch 142 may be controlled by control signal 133 in a manner described above. If the PWM signal 372 is LOW, the output signal 382 may be driven HIGH so that the switch 142 is turned OFF. Of course, the output signal 382 may be driven HIGH when the PWM signal is LOW by simply reversing the logic inside the multiplexer. In this case, the LED string 204 may be an open circuit and no current may flow through the LEDs. In this manner, LED string 204 may be repeatedly turned ON and OFF at a selected duty cycle to adjust the average current flow through the string 204 for performing the dimming control, which may to achieve a desired brightness of string 204.

Multiplexer 304 may have a first input configured to receive a pulse width modulated (PWM) signal 374 and a second input configured to receive control signal 135. The multiplexer circuitry 304 may generate an output signal 384 based on the PWM signal 374 and control signal 135. The PWM signal 374 may comprise a low frequency burst mode signal, and may be designated for specific brightness control of the blue LED string 206. For example, the PWM signal 374 may comprise a rectangular waveform having a selected ON-OFF duty cycle, i.e., the waveform swings from HIGH to LOW based on a selected duty cycle. The frequency of the PWM signal 374 may be selected to avoid flickering of the LEDs, for example, several hundred Hertz.

In operation, if the PWM signal 374 is HIGH, the output signal 384 of the multiplexer may be the control signal 135. Thus, when the PWM signal 374 is HIGH, switch 144 may be controlled by control signal 135 in a manner described above. If the PWM signal 374 is LOW, the output signal 384 may be driven HIGH so that the switch 144 is turned OFF. Of course, the output signal 384 may be driven HIGH when the PWM signal is LOW by simply reversing the logic inside the multiplexer. In this case, the LED string 206 may be an open circuit and no current may flow through the LEDs. In this manner, LED string 206 may be repeatedly turned ON and OFF at a selected duty cycle to adjust the average current flow through the string 206, which may achieve a desired brightness of string 206.

Multiplexer 306 may have a first input configured to receive a pulse width modulated (PWM) signal 376 and a second input configured to receive control signal 137. The multiplexer circuitry 306 may generate an output signal 386 based on the PWM signal 376 and control signal 137. The PWM signal 376 may comprise a low frequency burst mode signal, and may be designated for specific brightness control of the green LED string 208. For example, the PWM signal 376 may comprise a rectangular waveform having a selected ON-OFF duty cycle, i.e., the waveform swings from HIGH to LOW based on the selected duty cycle. The frequency of the PWM signal 376 may be selected to avoid flickering of the LEDs, for example, several hundred Hertz.

In operation, if the PWM signal 376 is HIGH, the output signal 386 of the multiplexer may be the control signal 137. Thus, when the PWM signal 376 is HIGH, switch 146 may be controlled by control signal 137 in a manner described above. If the PWM signal 376 is LOW, the output signal 386 may be driven HIGH so that the switch 146 is turned OFF. Of course, the multiplexer of this embodiment may be configured so that output signal 386 may be driven HIGH when the PWM signal is LOW. In this case, the LED string 208 may be an open circuit and no current may flow through the LEDs. In this manner, LED string 208 may be repeatedly turned ON and OFF at a selected duty cycle to adjust the average current flow through the string 208, which may achieve a desired brightness of string 208.

In one embodiment, the duty cycle of one or more PWM signals may be adjusted relative to the other PWM signals, which may offer enhanced human perception. For example, the duty cycle of PWM signal 372, which controls the red LEDs in this embodiment, may have a duty cycle that is a ratio of 2:1 compared with the duty cycle of PWM signals 374 and/or 376 (controlling the blue and green LEDs, respectively). For example, when Red LEDs are adjusted with 60% ON and 40% OFF for dimming, it may be desirable to have 30% ON and 70% OFF for both Green and Blue LEDs to optimize the color performance, which may better achieve overall white light quality. Accordingly, it is fully contemplated herein that the duty cycle of the PWM signals 372, 374 and 376 may be selectable and/or programmable relative to one another.

Figure 6:
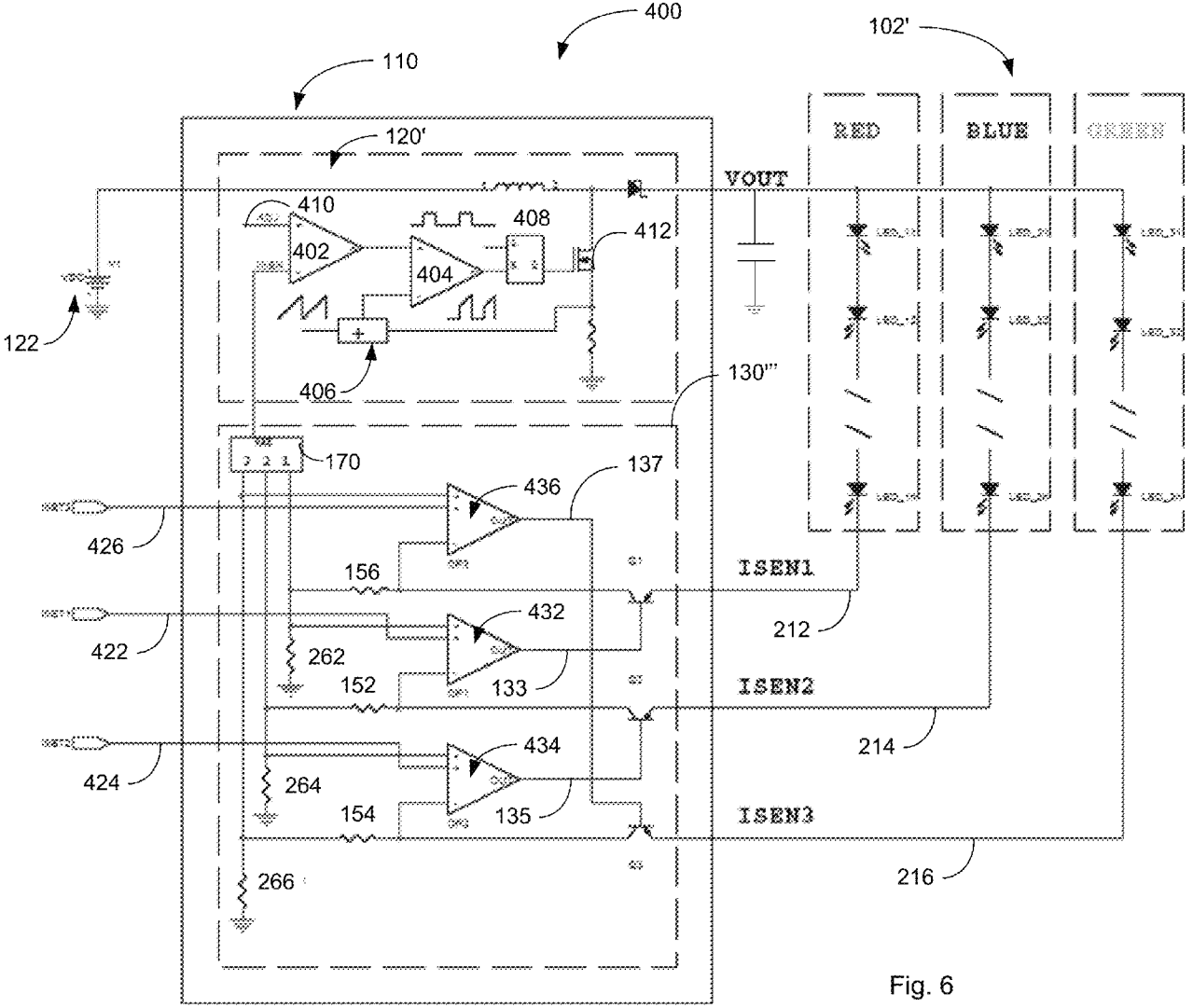
FIG. 6 illustrates another exemplary system embodiment of the claimed subject matter.

FIG. 6 illustrates another exemplary system embodiment 400 of the claimed subject matter. In this embodiment, DC/DC converter circuitry 120' may include a boost converter. The boost converter may include a first comparator 402 that compares one of the current feedback signals from the LED array 102' to an adjustment signal. Error amplifier 402 compares the current sense signal Isen, and a reference signal ADJ. The result of the signal is comparing with a slope compensated current sense signal in the switch of the boost converter. The current flowing through switch is added with a saw-tooth via 406. The output of the 406 is one of the inputs to comparator 404. The output of the comparator 404 is a rectangular wave which feeds into a driver such as a flip-flop, to drive switch in the boost converter.

As described above, the ratio of current flow through each string may be adjusted by burst mode dimming and/or by selecting the values of the sense resistors 262, 264 and/or 266. In this embodiment, feedback circuitry 130''' may include amplifiers 432, 434 and 436 which may be capable of adjusting the effective resistance of associated sense resistors 262, 264 and/or 266, respectively. In this example, programmable input signals 422, 424 and 426 may be supplied to respective amplifiers 432, 434 and 436. Programmable input signals 422, 424 and 426 may be proportional to a desired current level in a given string.

In operation, the value of input signal 422 may be adjusted up or down, and accordingly, the effective resistance of sense resistor 262 may be adjusted up or down. As described above, this may form a ratio of current values between the first and second strings. The value of input signal 424 of may be adjusted up or down, and accordingly, the effective resistance of sense resistor 264 may be adjusted up or down. As described above, this may form a ratio of current values between the second and third strings. Similarly, the value of input signal 426 of may be adjusted up or down, and accordingly, the effective resistance of sense resistor 266 may be adjusted up or down. As described above, this may form a ratio of current values between the third and first strings. These operations may produce a desired and/or programmable current flow through one or more LED strings.

Of course, any of the embodiments described herein may be extended to include n-number of LED strings. In accordance with the teachings herein, if n-number of LED strings are used, a corresponding number of amplifier circuits and switches may also be used. Likewise, a corresponding number of multiplexer circuits may be used, depending on the number of LED strings present.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Other modifications, variations, and alternatives are also possible. Accordingly, the claims are intended to cover all such equivalents.

What is claimed is:

1. A controller for controlling a light-emitting diode (LED) array which comprises at least one string of LEDs, comprising:

feedback circuitry coupled to the LED array and configured to receive a first and a second signals, wherein at least one of the received signals is associated with a current flowing through one of the at least one string of LEDs, and compare the first and the second signals to output a first control signal; and dimming circuitry coupled to the feedback circuitry and configured to control the current flowing through the string of LEDs and receive a second pulse-width modulation (PWM) control signal to turn on and off of the string of LEDs.

2. The controller of claim 1, wherein the feedback circuitry comprises an amplifier configured to generate the first control signal by comparing the first and second signals.

3. The controller of claim 2, wherein the feedback circuitry further comprises a switch coupled to the amplifier and the string of LEDs for adjusting the current flowing through the string of LEDs.

4. A system comprising: an LED array comprising at least one string of LEDs; feedback circuitry coupled to the LED array and configured to receive a first and a second signals, wherein at least one of the received signals is associated with a current flowing through one of the at least one string of LEDs, and compare the first and the second signals to output a first control signal; and dimming circuitry coupled to the feedback circuitry and configured to control the current flowing through the string of LEDs and receive a second pulse-width modulation (PWM) control signal to turn on and off of the string of LEDs.

5. The system of claim 4, wherein the feedback circuitry comprises an amplifier configured to generate the first control signal by comparing the first and second signals.

6. The system of claim 5, wherein the feedback circuitry further comprises a switch coupled to the amplifier and the string of LEDs for adjusting the current flowing through the string of LEDs.

* * * * *